US005586195A

United States Patent [19]

Ishigaki et al.

[11] Patent Number: 5,586,195

[45] Date of Patent: Dec. 17, 1996

[54] BODY-ACOUSTIC DEVICE

[75] Inventors: Hitomi Ishigaki, Yokohama; Masako Tamura, Saitama-ken, both of Japan

[73] Assignee: Capcom Co., Ltd., Osaka, Japan

[21] Appl. No.: 256,532

[22] PCT Filed: Aug. 23, 1993

[86] PCT No.: PCT/JP93/01178

§ 371 Date: Jul. 15, 1994

§ 102(e) Date: Jul. 15, 1994

[87] PCT Pub. No.: WO94/12001

PCT Pub. Date: May 26, 1994

[30] Foreign Application Priority Data

Nov. 18, 1992 [JP] Japan ..... 4-308674

[51] Int. Cl.[6] ..... H04R 25/00

[52] U.S. Cl. ..... 381/188; 381/186; 381/151; 381/205

[58] Field of Search ..... 381/188, 151, 381/186, 182, 184, 193, 192, 205, 202, 203, 204; 181/144, 145, 148, 157, 160, 163, 164, 165, 171, 172, 199; 340/388.3, 388.4, 391.1

[56] References Cited

U.S. PATENT DOCUMENTS 4,232,204 11/1980 Rojas ..... 381/186

FOREIGN PATENT DOCUMENTS 0251430 1/1988 European Pat. Off. .
2919884 11/1979 Germany .
32-9407 8/1957 Japan .
58-2516 1/1983 Japan .
59-149789 10/1984 Japan .
61-68600 5/1986 Japan .
61-111299 7/1986 Japan .
0202099 8/1989 Japan ..... 381/151
1288092 11/1989 Japan ..... 381/151
2266797 10/1990 Japan .

OTHER PUBLICATIONS

Abstract, JP–A–03 085096, Publication date: Apr. 10, 1991.
Abstract, JP–A–01 288096, Publication date: Nov. 20, 1989.

*Primary Examiner*—Sinh Tran
*Attorney, Agent, or Firm*—Michael D. Bednarek; Kilpatrick & Cody

[57] ABSTRACT

A body-acoustic device is provided which comprises a housing (1), a diaphragm (4) dividing an inner space of the housing into a first chamber (5) and a second chamber (6), and a loudspeaker (7) mounted to an opening provided in the diaphragm, wherein the diaphragm is made of a transversely vibratory member and/or has a perimetric edge supported by an inner surface of the housing via an elastic member (10), and wherein the diaphragm (4) is further provided with a port (9) for air movement between the first and second chambers (5), (6). When the loudspeaker (7) is operated, the diaphragm vibrates with a cone paper (8) to generate sufficient heavy bass sound with high sound clarity as if the diameter of the loudspeaker had increased. The port provided in the vibrating diaphragm facilitates the vibration of the diaphragm, further increasesing the sound pressure created by the diaphragm vibration due a sound throttling effect caused by the port. As a result, sufficient and clear body-felt sound, especially heavy bass sound, can be obtained through vibration of the housing outer walls.

4 Claims, 2 Drawing Sheets

BODY-ACOUSTIC DEVICE

FIELD OF THE INVENTION

The present invention relates to a body-acoustic device wherein acoustic signals in the form of electric output from such systems as an audio system, arcade amusement machine, or home video game system are converted into mechanical vibration to a human body. More particularly, the present invention relates to a body-acoustic device wherein sound pressure from a loudspeaker causes the outer walls of the loudspeaker's housing to vibrate for transmission to a human body.

BACKGROUND ART

In general, a body-acoustic device of the above type includes a housing wherein an inner space of the housing is divided into two parts by a diaphragm having an opening for mounting a loudspeaker. When the loudspeaker is operated, sound pressure from the loudspeaker vibrates the outer walls of the housing.

An example of such a sonic body resonator is disclosed in the Japanese Patent Application Laid-Open 2-266797. Particularly, FIG. 4 of this laid-open application discloses a loudspeaker housing comprising a pair of dish-shaped vibrating elements joined together to form a discoid. The inner space of this discoidal housing is divided, in its thickness direction, into two parts by a diaphragm made of a relatively hard material such as wood, and the diaphragm has an opening for mounting a loudspeaker.

However, a problem with this type of body-acoustic device is that when the inner spaces of the housing are completely segregated from each other by the diaphragm, it becomes impossible to vibrate the entire outer wall of the housing, failing to produce satisfactory body-acoustic effect.

The loudspeaker mounted to the diaphragm may be made to have a larger diameter and a larger output for increasing vibration propagated on the outside wall of the housing while also enhancing bass sound. However, this measure makes it necessary to increase the overall size of the housing for accommodating the diametrically larger loudspeaker, resulting in a weight increase of the body-acoustic device and a higher manufacturing cost. Thus, the body-acoustic device becomes unsuitable as a peripheral device for a low-cost video game system.

It is, therefore, an object of the present invention to provide a body-acoustic device wherein a diametrically small speaker having a small output can provide sufficient body vibration as well as sufficient propagation of bass sound.

Another object of the present invention is to provide a small and light sonic body resonator which can be manufactured at a low cost but yet create sufficient body-felt sound effect.

DISCLOSURE OF THE INVENTION

In order to achieve the above objects, a body-acoustic device according to the present invention comprises a housing, a diaphragm dividing the inner space of this housing into a first chamber and a second chamber, and a loudspeaker mounted to an opening of the diaphragm. The diaphragm may preferably comprises a transversely vibratory member. In addition, the diaphragm may be provided with a port for allowing air movement between the first and second chambers.

According to a preferred embodiment, the diaphragm is supported at its perimetric edge by an inner surface of the housing via an elastic member. Further, the entire housing or at least a part of the housing opposite to the diaphragm, that is, a part for direct or indirect contact with the body of a user, is made of a transversely vibratory member.

According to a first aspect of the present invention, the diaphragm for mounting the loudspeaker is a transversely vibratory member. Hence, when the loudspeaker is operated, the entire diaphragm vibrates together with the vibration of the loudspeaker's cone paper, which is equivalent to an enlargement of the loudspeaker diameter. As a result, the sound pressure from the loudspeaker is enhanced, making it possible to obtain sufficient sound effect, especially with respect to heavy bass sound, even if the diameter of the loudspeaker itself is small.

Such a sound enhancement effect can be further intensified, as in the preferred embodiment, by using the elastic member for mounting the perimetric edge of the diaphragm onto the inner wall of the housing embodiment because the diaphragm becomes less restrained from vibrating with the loudspeaker's cone paper.

Further, the elastic member of the preferred embodiment placed between the diaphragm perimetric edge and the housing inner wall substantially improves sound clarity because direct propagation of unnecessary vibration to the housing is restrained.

According to a second aspect of the present invention, the diaphragm dividing the inner space of the housing into the first and second chambers is provided with a port for allowing air movement between the first and second chambers. Thus, transverse vibration of the diaphragm caused by the loudspeaker is further facilitated. In addition, when the diaphragm vibrates and the air moves through the port, the sound pressure is further intensified by the so-called sound throttling effect, thereby effectively increasing the vibration of the housing.

As an overall result of the first and second aspects of the present invention, even if a diametrically small loudspeaker is used, it is possible to generate sufficient vibration of the housing outer walls particularly with respect to bass sound while enhancing sound clarity. Further, it is also possible to reduce the overall size and production cost of the sonic body resonator.

BEST MODE FOR CARRYING OUT THE INVENTION

Figure 1:
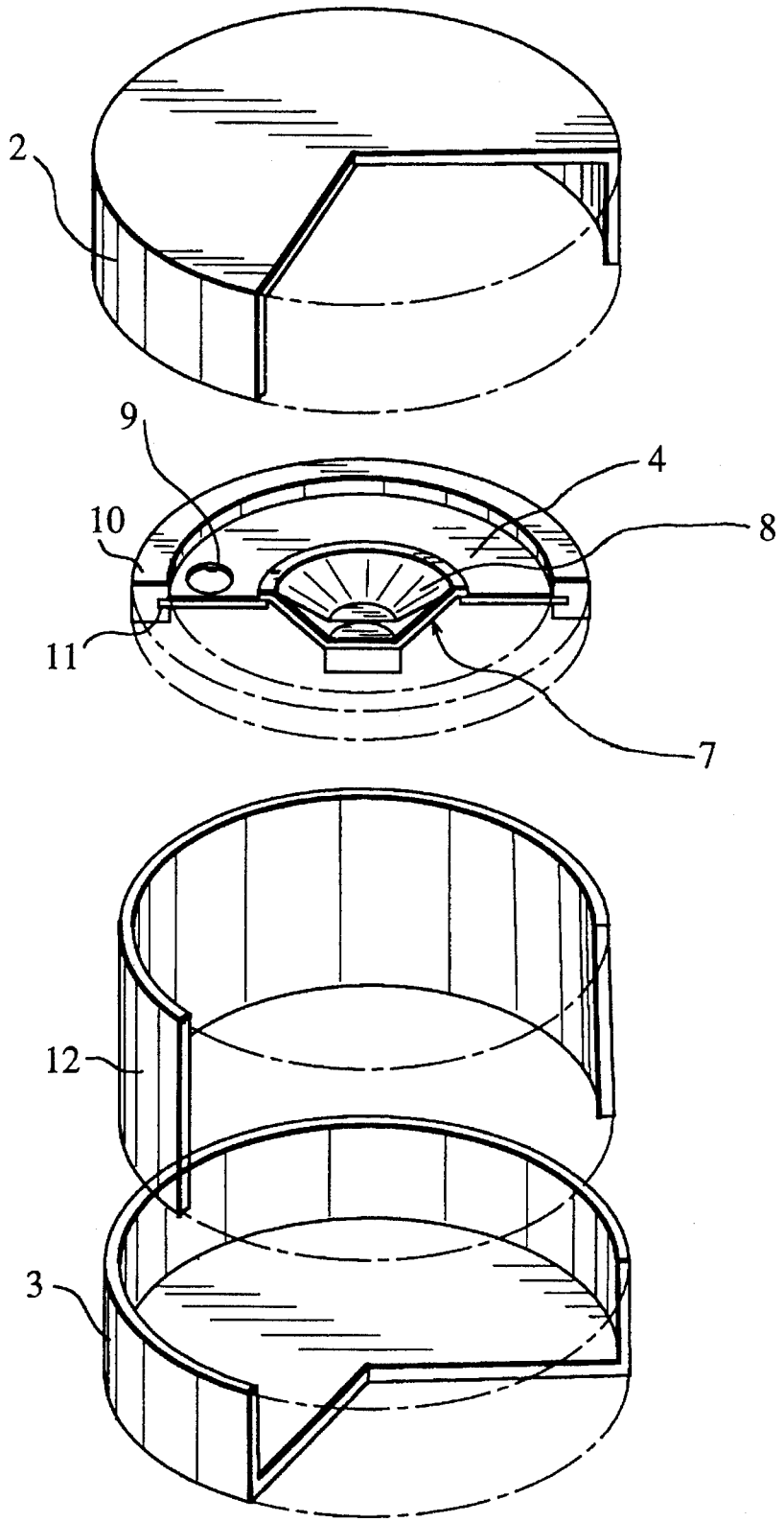
FIG. 1 is an explosive perspective view of a body-acoustic device embodying the present invention.
Figure 2:
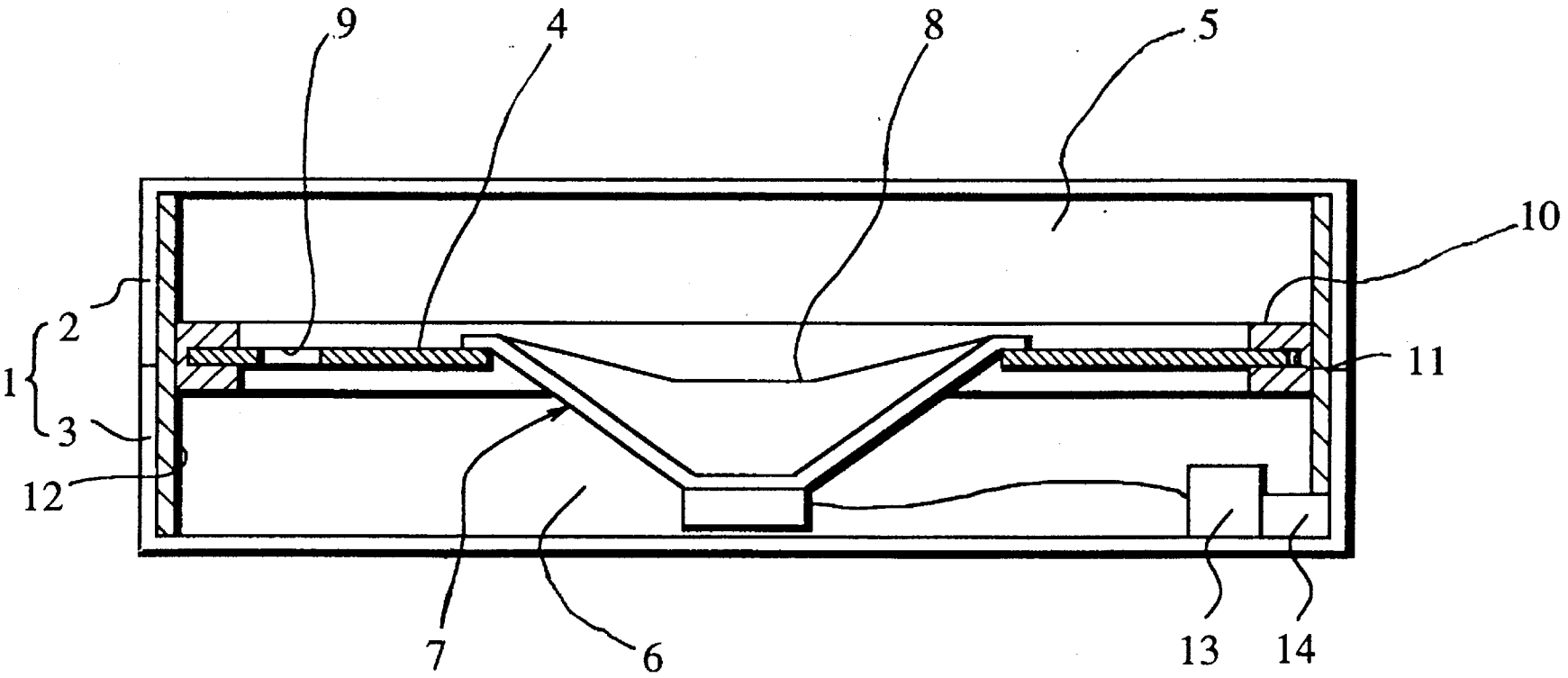
FIG. 2 is a vertical sectional view of the body-acoustic device shown in FIG. 1.

The present invention will now be described in more detail with reference to the attached drawings.

A body-acoustic device according to the present invention basically comprises a housing 1, a diaphragm 4 which divides the inner space of the housing into a first chamber 5 and a second chamber 6, and a loudspeaker 7 mounted to an opening of the diaphragm 4. In the illustrated embodiment, the housing 1 is a cylinder which includes a joined pair of housing halves 2, 3 each in the form of a bottomed cylinder made of semi-hard polypropylene. The housing halves 2, 3 are connected to each other by a cylindrical joint 12 fitted in the housing halves 2, 3.

Since the housing halves 2, 3 are each formed of semi-hard polypropylene, the housing as a whole is deformable under external forces, but the rigidity of the cylindrical side wall is increased by the fitted cylindrical joint 12. The circular bottom or end of each housing half 2 or 3 is transversely deformable for vibration under sound pressure from the loudspeaker 7 to be described later.

The diaphragm 4 may be preferably made of a semi-hard, tough and readily vibratable material such as polypropylene similar the material for the housing 1. The diaphragm 4 is centrally provided with an opening adapted for mounting the loudspeaker 7 whose diameter is relatively small.

The diaphragm 4 is supported by the inner surface of the cylindrical side wall of the housing 1, that is, the inner surface of the cylindrical joint 12 in the illustrated embodiment, via an elastic member 10. The elastic member 10 is made of a highly hermetical material such as polyurethane foam or rubber and has an annular groove 11 for receiving the perimetric edge of the diaphragm 4. The outer circumference of the elastic member is fixed, by adhesive for example, to the inner surface of the cylindrical joint 12.

Further, the diaphragm 4 is provided with a port 9 which allows air to move between the first and second chambers 5, 6 divided by the diaphragm.

The second chamber 6 of the housing 1 accommodates a speaker driving amplifier 13 having a frequency-halving circuit, and a connecter 14 for connection to power supply wires.

With the above-described arrangement, when the loudspeaker 7 is operated, the diaphragm 4 itself can vibrate with the cone paper 8 of the loudspeaker 7 because the diaphragm 4 carrying the loudspeaker 7 is transversely deformable and because the perimetric edge of the diaphragm a is supported via the elastic member 10 by the inner wall of the housing 1. This means that even the diameterically small loudspeaker 7 can provide a sufficient sound pressure effect which is equivalent to that obtainable when the diameter of the loudspeaker 7 is increased. Particularly, the diametrically small loudspeaker 7 can generate sufficient heavy bass sound with remarkably improved sound clarity.

Further, the port 9 provided in the diaphragm for establishing communication between the first and second chambers 5, 6 further enhances the vibration of the diaphragm 4 with the cone paper 8 when the loudspeaker 7 is driven. At the same time, upon vibration of the diaphragm 4, the port 9 provides a sound throttling effect which increases the sound pressure. These factors contribute to intensifying the vibration on the outer walls of the housing, namely the respective end walls of the housing halves 2, 3. As a result, when the loudspeaker 7 is operated with the housing 1 held in contact with the user's body, the user can sufficiently feel the sound, particularly heavy bass sound, with outstanding sound clarity through body stimulation.

In this way, the sonic body resonator according to the present invention can provide satisfactory and excellent body-felt sound even if use is made of a diametrically small loudspeaker, thereby enabling a price reduction and a compact design.

Further, since the housing 1 of the illustrated embodiment is formed of semi-hard polypropylene which has both toughness and flexibility, the housing can transmit the speaker sound to the human body at a high fidelity and clarity while being readily adaptable to the human body but yet providing sufficient strength and durability for heavy-duty use. Furthermore, polypropylene as a material for the housing 1 has a number of advantages such as ease in blow forming, considerablly low manufacturing cost, and light weight, all contributing further to the weight and cost reduction in the body-acoustic device according to the present invention.

The scope of the present invention is not limited to the embodiment described hereinabove, and all design modifications to be made under the spirit set forth in the appended claims are included within the scope of the present invention. For example, the diaphragm 4 may be made not only of semi-hard synthetic resin but also of a cardboard or the like. Although it is preferable that the diaphragm 4 have a certain degree of flexibility for transverse deformation, the diaphragm may have a certain degree of rigidity if the perimetric edge of the diaphragm 4 is supported by the inner surface of the housing via the elastic member 10.

Conversely, if the diaphragm 4 is flexible for enabling transverse vibration, substantially the same effect as described above can be expected even if the diaphragm perimetric edge is connected to the housing inner surface without using the elastic member 10.

Finally, experiments have revealed that, for better sound effect, the port 9 in the diaphragm 4 should be brought away from the loudspeaker 7 to be located as close to the outer edge of the diaphragm as possible, and such a port should be provided only at one position rather than at a plurality of positions.

We claim:

1. A body-acoustic device comprising a housing, a diaphragm having an opening and dividing an inner space of the housing into a first chamber and a second chamber, and a loudspeaker mounted to the opening of the diaphragm, wherein the diaphragm is made of a traversely vibratory member, the diaphragm being provided with a port for allowing air movement between the first and second chambers, and wherein the housing has no sound outlet opening so that the housing is substantially closed.

2. The body-acoustic device according to claim 1, wherein the diaphragm has a perimetric edge supported by an inner surface of the housing via an elastic member.

3. A body-acoustic device comprising a housing, a diaphragm having an opening and dividing an inner space of the housing into a first chamber and a second chamber, and a loudspeaker mounted to the opening of the diaphragm, wherein the diaphragm is provided with a port for allowing air movement between the first and second chambers, the diaphragm having a perimetric edge supported by an inner surface of the housing via an elastic member, and wherein the housing has no sound outlet opening such that the housing is substantially closed.

4. The body-acoustic device according to claim 3, wherein at least part of the housing opposed to the diaphragm is made of a transversely vibratory member.

* * * * *